United States Patent [19]

Onoe et al.

[11] Patent Number: 4,541,473

[45] Date of Patent: Sep. 17, 1985

[54] APPARATUS FOR SPRAYING AN AIR-WATER MIST COOLING FOR USE IN CONTINUOUS METAL CASTING

[75] Inventors: Yoshinori Onoe, Akashi; Hiroshi Takagi, Kobe; Satoru Ikenaga, Kobe; Hiraku Tsuchiya, Kobe; Shohei Murakami, Hyogo; Masakazu Nakao, Kobe, all of Japan

[73] Assignee: Kabushiki Kaisha Kobe Seiko Sho, Kobe, Japan

[21] Appl. No.: 582,707

[22] Filed: Feb. 23, 1984

[30] Foreign Application Priority Data

Feb. 25, 1983 [JP] Japan ..... 58-27612[U]

[51] Int. Cl.[4] ..... B22D 11/124

[52] U.S. Cl. ..... 164/444; 164/486; 239/557; 239/434

[58] Field of Search ..... 239/557, 434; 164/486, 164/487, 444

[56] References Cited

U.S. PATENT DOCUMENTS 4,250,951 2/1981 Mezger et al. ..... 164/444
4,483,482 11/1984 Junger et al. ..... 239/434

FOREIGN PATENT DOCUMENTS 1044572 11/1953 France ..... 239/568
908494 3/1982 U.S.S.R. ..... 164/444

*Primary Examiner*—W. D. Bray
*Attorney, Agent, or Firm*—Oblon, Fisher, Spivak, McClelland & Maier

[57] ABSTRACT

An exhaust hole is formed in an exhaust side wall of a mist atomizing nozzle of an apparatus for spraying the mist for cooling for and is used in continuous metal casting. An introduction inlet is provided in an introducing side wall on the side opposite the exhaust side wall at the height position different from that of the exhaust hole. An air-water mixture supply pipe is attached to the introduction inlet to communicate therewith. The air-water mixture of relatively large water droplets is formed and is introduced into the mist atomizing nozzle by that air-water mixture supply pipe. After the air-water mixture repeatedly collides in the mist atomizing nozzle, the large water droplets are made fine and are sequentially exhausted from the exhaust hole by being pressed by the supply pressure from the rear side.

6 Claims, 8 Drawing Figures

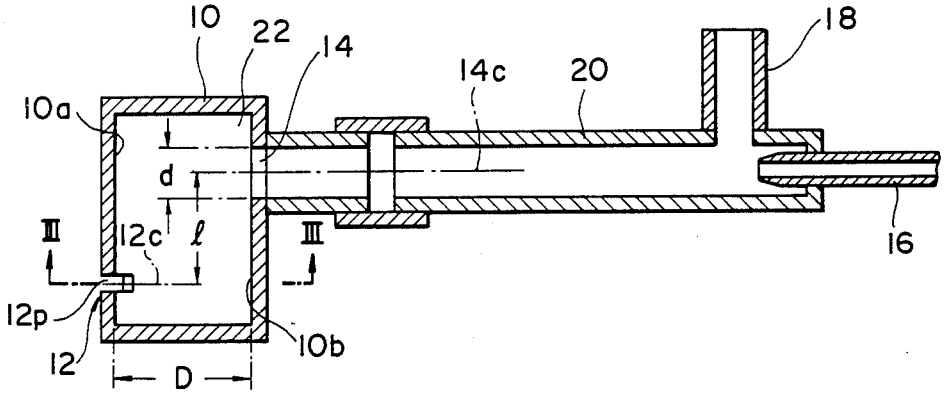

APPARATUS FOR SPRAYING AN AIR-WATER MIST COOLING FOR USE IN CONTINUOUS METAL CASTING

BACKGROUND OF THE INVENTION

1. Field of the Invention

The present invention relates to an apparatus for spraying an air-water mist to be used for cooling a cast strand in continuous metal casting.

2. Description of the Prior Art

A water spraying method has been conventionally and generally used as cooling means for a cast strand which is continuously pulled out in a continuous metal casting process; however, recently a air-water mist cooling method has become the main method whereby the surface cracks of a cast strand are reduced wherein the quantity of the water to be consumed is small and the cooling efficiency is high.

In general, a cylindrical nozzle whose both ends are closed is used as a mist spraying apparatus and a slit-like exhaust hole which is parallel to the direction of diameter is formed and opens in the spraying side wall on the peripheral surface of the mist atomizing nozzle. On the other hand, a air-water mixture supply pipe communicates with the introduction side wall on the side opposite to the spraying side wall. In this construction, the central axis of the introduction inlet of the edge portion of the air-water mixture supply pipe and the central line passing through the midpoint of the exhaust hole of the mist atomizing nozzle which is parallel to that central axis are arranged substantially in line.

Due to this, relatively large water droplets in the air-water mixture supply pipe are sprayed from the exhaust hole without being formed as the mist. Consequently, it has been impossible to make the most of the advantages as a feature of the mist cooling method, such as improvement in surface cracks of a cast strand or in cooling efficiency utilizing the latent heat of vaporization of the mist.

In addition, another method is known whereby an orifice is provided at the introduction inlet of the edge portion of the air-water mixture supply pipe in order to make water droplets fine (i.e. Japanese Patent Kokai (Laid-Open) No. 12347/82). However, it is troublesome to form an orifice, the cost of the whole spraying apparatus is increased and a problem occurs in that if the orifice is choked with a foreign matter, it is extremely difficult to remove. There is, furthermore, a fear that unless the pressures of the air and water on the supplying side are raised, the cooling ability may be lacking since the quantity of the mist to be sprayed from the exhaust hole will be insufficient.

SUMMARY OF THE INVENTION

It is an object of the present invention to provide an air-water mist spraying apparatus for use in continuous metal casting equipment which can make the mist for cooling remarkably fine and can exhaust this mist over a wide range, thereby enabling a cast strand to be uniformly and efficiently cooled over a wide range.

The above object is accomplished by a mist spraying apparatus constituted as follows. Namely, an exhaust hole is formed in the spraying side wall of a nozzle for spraying the mist for cooling which is used in continuous metal casting, while an introduction inlet is provided in the introduction side wall on the side opposite to the spraying side wall so that the height position of this inlet is different from that of the exhaust hole. That is, the height position of the introduction inlet is set into a value so that a distance l between the central axis of the introduction inlet and the central line passing through the midpoint of the exhaust hole which is parallel to that central axis satisfies the following relation, $$\frac{1}{2}d < l \leqq 2.5D$$

wherein, d is an inside diameter of the introduction inlet and D is a distance from the introduction side wall of the mist atomizing nozzle to the spraying side wall. A air-water mixture supply pipe is attached to the introduction inlet so as to communicate therewith. The air-water mixture of relatively large water droplets are formed by the air-water mixture supply pipe, and this air-water mixture is introduced from the introduction inlet into the mist residence chamber. After the air-water mixture repeatedly collides a number of times in the mist residence chamber, it is transformed into fine droplets which are then sequentially exhausted from the exhaust hole by being pressed by the supply pressure from the rear side.

According to the present invention, the following effects can be obtained.

(a) The mist is made remarkably fine and a cast strand can be uniformly cooled by making the most of a feature of a mist cooling method whereby the surface cracks of a cast strand are reduced and the cooling efficiency is improved utilizing the latent heat of vaporization of the mist.

(b) The construction of a mist atomizing nozzle is simplified and can be easily manufactured, thereby enabling problems in operation when the mist atomizing nozzle is used to be avoided.

(c) An exhaust hole can be easily formed and the mist spraying stream can be properly widened in the width direction of a cast strand, thereby enabling the cast strand to be cooled over a wide range.

(d) By setting a spreading angle of the exhaust hole, the extent of the mist spraying stream in the width direction of a cast strand can be determined, thereby enabling only the cast strand to be effectively cooled.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

BRIEF DESCRIPTION OF THE PREFERRED EMBODIMENTS

Figure 1:
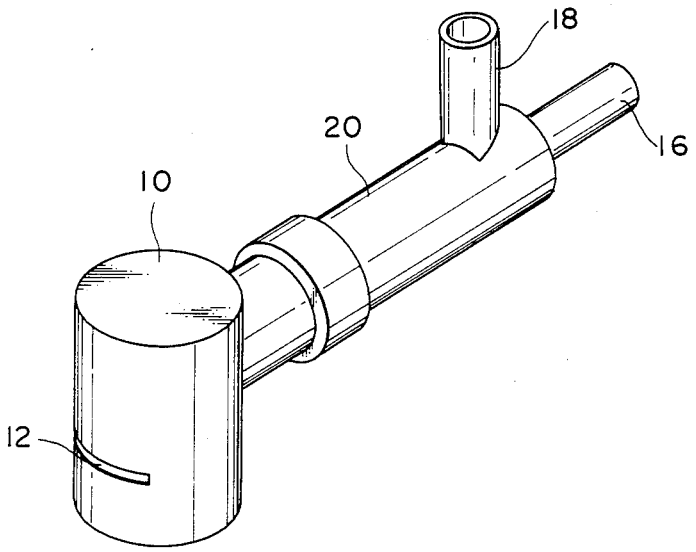
FIG. 1 is a schematic perspective view showing an apparatus for spraying the mist for cooling a cast strand in accordance with the present invention.
Figure 2:
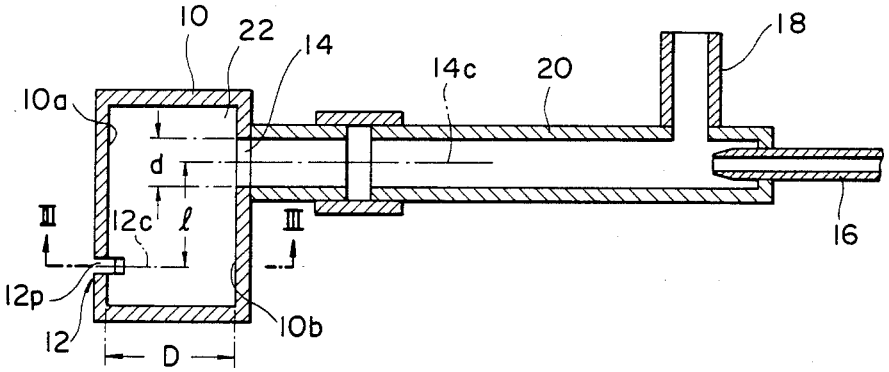
FIG. 2 is a schematic vertical cross sectional view of FIG. 1.
Figure 3:
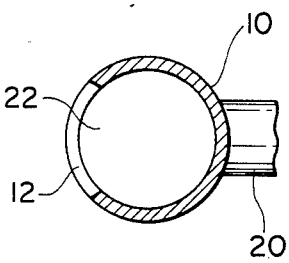
FIG. 3 is a cross sectional view taken along the line III—III of FIG. 2.
Figure 4:
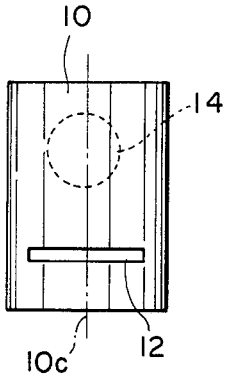
FIG. 4 is a left side elevational view of FIG. 2.

The construction and a functional effect of the present invention will be described hereinbelow with reference to the drawings illustrating various embodiments of the present invention. However, these drawings show typical examples and the present invention is not limited to this, but proper various changes and modifications of the dimensions and construction of a mist atomizing nozzle and of the shape and dimensions of a mist exhaust hole or the like are all included in the technical scope of the invention without departing from the spirit of the invention.

In the drawings, reference numeral 10 denotes a typical cylindrical mist atomizing nozzle whose opposite ends are closed, in which a slit-like exhaust hole 12 which is parallel to the direction of diameter is formed and opens in an exhaust side wall 10*a*. An introduction inlet 14 is provided in an introduction side wall 10*b* on the side opposite to the opening portion of the exhaust hole 12. This introduction inlet 14 communicates with an air-water mixture supply pipe 20 to which a water supply pipe 16 and an air supply pipe 18 are connected at the distal end thereof.

In this embodiment, the improvement relates to the exhaust hole 12 which opens in the mist atomizing nozzle 10 and to the position of the introduction inlet 14 as the communicating position with the air-water mixture supply pipe 20. Namely, it should be noted that the exhaust hole 12 is formed in the position which is offset from the mist spraying surface on a line extending in the direction of introduction of the air-water mixture of the supply pipe 20; this aspect being a fundamental concept of the present invention. Another fundamental concept of the invention is that no orifice is formed in the introduction inlet 14 into a residence chamber 22 formed in the mist atomizing nozzle 10. Therefore, the air-water mixture of relatively large water droplets formed in the air-water mixture supply pipe 20 is sent as is from the introduction inlet 14 into the residence chamber 22 in the mist atomizing nozzle 10. However, this large water-droplets mixture firstly collides with the exhaust side wall 10*a* of the nozzle 10 and are rebounded. In this manner, after the large water droplets repeatedly collide between the inner walls of the nozzle 10, they are sequentially exhausted from the exhaust hole 12 by being influenced by the supply pressure from the rear side. The water droplets are broken due to such collision with the walls and the collision with each other, so that they form a fine mist. Therefore, the mist to be sprayed from the exhaust hole 12 is extremely fine, thereby providing a high cooling effect. In order to obtain such as effect, it is inevitable that the exhaust hole 12 be in the position which is offset from the flow-in direction of at least the air-water mixture as mentioned in the first fundamental concept. In other words, assuming that the distance between a central axis 14*c* of the introduction inlet 14 and a central line 12*c* passing through a midpoint 12*p* of the exhaust hole 12 parallel to and on the same plane as the central axis 14*c* is l, and that the inside diameter of the introduction inlet 14, for example the bore of the circular introduction inlet 14 is d, there is a relation of $[\frac{1}{2}d \geqq l]$ between the distance l and the bore d since the gap of the exhaust hole 12 is small enough that it can be substantially neglected, the exhaust hole 12 faces the introduction inlet 14 and a part of the air-water mixture of large droplets which are not made fine is directly sprayed from the exhaust hole 12, so that the effect of the present invention cannot be substantially obtained. On the other hand, from the viewpoint of the effect of making fine water droplets due to the collision of the air-water mixture, it is considered to be desirable to set the distance l as a larger value. However, when the distance l is too large, the residence time of the air-water mixture in the mist atomizing nozzle 10 becomes relatively long and the pressure lost also becomes large, so as to cause the flow velocity to be reduced and a tendency that the fine water droplets which have been once made fine to combine together again and become large water droplets. As a result, this contrarily diminishes the effect of making the mist particles fine.

Experiments have thus been conducted to determine the upper limit value of the distance l to solve the above problem. Now assuming that the distance from the introduction side wall 10*b* of the mist exhaust hole 12 to the exhaust side wall 10*a*, for example the bore of the cylindrical mist atomizing nozzle 10 is D, the distance l and bore D were adjusted so as to meet the relation of $l \leqq 2.5D$. Thus, it is possible to effectively accomplish the object of making the mist fine. From these facts, in the present invention, the distance l was set so as to satisfy the relation of $|\frac{1}{2}d < l \leqq 2.5D|$. The exhaust hole of a slit-like or dot-hole-like shape may be used.

Figure 5:
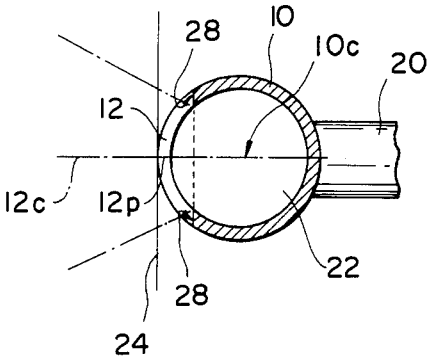
FIGS. 5 and 6 are explanatory diagrams showing practical examples of the cutting shapes of both edge portions of an exhaust hole.
Figure 6:
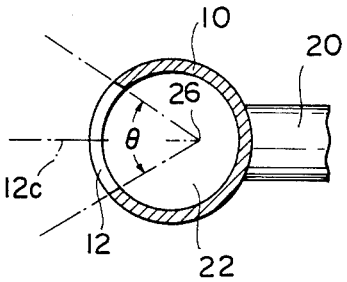

In the case using the slit-like exhaust hole 12, the following two types of cutting angles on both sides in a longitudinal direction are available. One is the case where both sides are cut at the surface which is parallel to both a central tangential line 24 of the exhaust hole 12 and the central line 10*c* of the mist atomizing nozzle 10 as shown in FIG. 5. The other is the case where, as shown in FIG. 6, both sides are cut at the surface which opens (opening angle $\theta$) like a fan from a point 26 in the mist atomizing nozzle 10 on the central line 12*c* perpendicular to the central tangential line 24. The difference between these cutting surfaces causes the cooling effect to slightly differ. Namely, in the example of FIG. 5, the side edges in the longitudinal direction of the exhaust hole 12 project sharply inwardly. Thus, negative pressures are caused to occur in the positions indicated by numerals 28 in FIG. 5 and function to widen the mist spraying stream in the direction of width, so that the mist is slightly spread in the direction of width and exhausted. On the contrary, in the case of the exhaust hole 12 of FIG. 6, since the negative pressures such as mentioned above are hardly caused, the mist is exhausted in the direction of a cast strand with a spreading angle which is almost equal to the opening angle (equal to the central angle $\theta$) of the exhaust hole 12.

Figure 7:
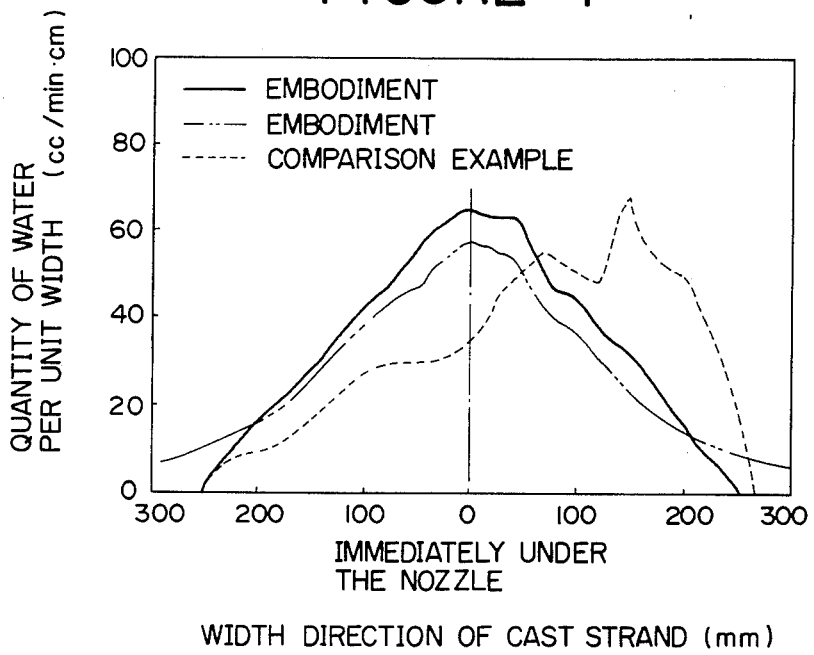
FIG. 7 shows an experimental data diagram representing the influence of the cutting shapes of both edge portions of FIGS. 5 and 6 in the distribution of the quantity of the water per unit width in the width direction of a cast strand.

FIG. 7 shows the difference in the distributions of the quantity of the water per unit width in the direction of the width of a cast strand which is caused with dependence upon the difference in the cutting direction of the exhaust hole 12. In FIG. 7, the alternate long and double short dashed line indicates the experimental data in the case where the nozzle of FIG. 5 was used, while the solid line represents the experimental data in the case where the nozzle of FIG. 6 (i.e., the spreading angle of the exhaust hole 12 from the position of $\frac{3}{4}$ of the diameter in the residence chamber 22 is 60°) was used, respectively. As obvious from these graphs, the mist spraying stream widely spreads in the direction of width of a cast strand in case of the exhaust hole 12 with the shape shown in FIG. 5, while the spread of the mist spraying stream in case of the exhaust hole 12 of FIG. 6 is slightly narrower than the case of FIG. 5. Therefore, an optimum cooling effect can be obtained by changing the cutting angle of the exhaust hole 12 in accordance with the lateral width of a cast strand to be cooled.

The broken line of FIG. 7 denotes the distribution of the experimental data in the case where a conventional mist spraying apparatus was used. It will be appreciated from this graph that the distribution is irregularly one-sided and uniform and stable cooling efficiency cannot be obtained.

Figure 8:
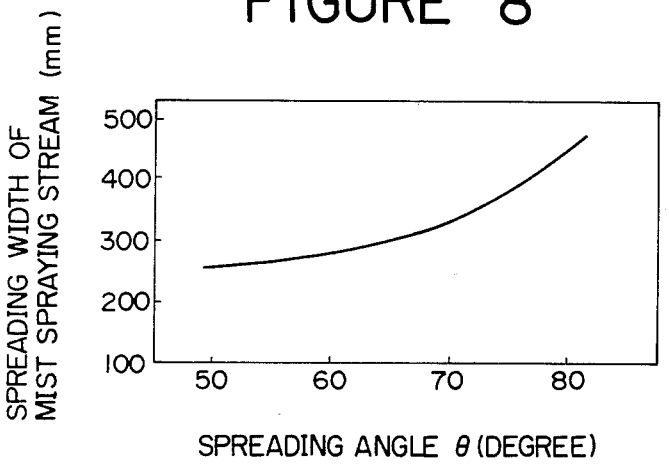
FIG. 8 shows an experimental data diagram representing the relationship between a spreading angle of the exhaust hole and an extent of the mist spraying stream.

On the other hand, FIG. 8 shows the relation between the opening angle $\theta$ shown in FIG. 6 and the spreading width (mm) of the mist which reached the surface of a cast strand. This relation was obtained on the basis of experiments. It will be understood that it is possible to adjust the degree of the extent of the mist spraying stream even by changing the opening angle $\theta$.

What is claimed is:

1. An apparatus for spraying an air-water mist for cooling a cast strand in continuous metal casting in which a mist atomizing nozzle is utilized which is attached to a head portion of an air-water mixture supply pipe, said apparatus comprising:

exhaust means formed in an exhaust side wall of said mist atomizing nozzle; and introduction inlet means provided in an introduction side wall at a height position different from that of said exhaust means wherein a distance l between a central axis of said introduction inlet means and a central line passing through a midpoint of said exhaust means parallel to said central axis is set at a predetermined value so as to satisfy the following relation, $$\frac{1}{2}d < l \leqq 2.5D$$

wherein d is an inside diameter of the introduction inlet means and D is a distance from the introduction side wall of said mist atomizing nozzle to the exhaust side wall.

2. A mist spraying apparatus according to claim 1, wherein said mist atomizing nozzle further comprises a cylindrical nozzle having opposite ends which are closed.

3. A mist spraying apparatus according to claim 1, wherein said exhaust means further comprises a slit-like shaped hole formed in said exhaust side wall of said nozzle parallel to a diameter direction thereof.

4. A mist spraying apparatus according to claims 1 or 2, wherein said exhaust means includes a plurality of dot-hole-like shaped holes formed in said exhaust side wall of said nozzle.

5. A mist spraying apparatus according to claim 3, wherein said slit-like exhaust hole further comprises a cut surface portion of said exhaust wall which is parallel to both a central tangetial line of said exhaust hole and the central line of said nozzle.

6. A mist spraying apparatus according to claim 3, wherein said slit-like exhaust hole further comprises a cut surface portion of said exhaust wall which forms a fan like opening from a point in the mist atomizing nozzle on the central line perpendicular to a central tangential line.

* * * * *